US006243121B1

(12) United States Patent
Agano

(10) Patent No.: US 6,243,121 B1
(45) Date of Patent: Jun. 5, 2001

(54) THERMAL PRINTER HAVING THERMAL HEAD WHICH PRESSES THERMAL RECORDING MATERIAL ON PLATEN ROLLER AT PREDETERMINED PRESSURE

(75) Inventor: Toshitaka Agano, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/510,152

(22) Filed: Feb. 22, 2000

(30) Foreign Application Priority Data

Feb. 22, 1999 (JP) ..... 11-043341

(51) Int. Cl.[7] ..... B41J 11/057; B41J 11/02
(52) U.S. Cl. ..... 347/220; 400/662
(58) Field of Search ..... 347/220; 400/662

(56) References Cited

FOREIGN PATENT DOCUMENTS 60-162672 * 8/1985 (JP) .
2-139265 * 5/1990 (JP) .
9-175037 * 7/1997 (JP) .
9-295440 11/1997 (JP) ..... B41J/25/312
10-76697 3/1998 (JP) ..... B41J/2/36
10-166640 6/1998 (JP) ..... B41J/2/36

OTHER PUBLICATIONS

Patent Abstract of Japan 09295440 Nov. 18, 1997.
Patent Abstract of Japan 10076697 Mar. 24, 1998.
Patent Abstract of Japan 10166640 Jun. 23, 1998.

* cited by examiner

*Primary Examiner*—Huan Tran
(74) *Attorney, Agent, or Firm*—Sughrue, Mion, Zinn, Macpeak & Seas, PLLC

(57) ABSTRACT

The thermal printer includes a thermal recording head and a platen roller. The thermal recording head records the image on a thermal recording material by contacting therewith at a predetermined pressure. The platen roller is arranged to face the thermal recording head and supports and transports the thermal recording material to be recorded thereon. The platen roller is covered with covering rubber in which the relation between hardness H (degree) and thickness t (mm) satisfies the following formula: $5t+30 \leqq H \leqq 5t+50$. The thermal printer is capable of obtaining a recorded image of high-quality without generating unevenness of an image, unevenness derived from a streak, a blur or the like.

6 Claims, 5 Drawing Sheets

THERMAL PRINTER HAVING THERMAL HEAD WHICH PRESSES THERMAL RECORDING MATERIAL ON PLATEN ROLLER AT PREDETERMINED PRESSURE

BACKGROUND OF THE INVENTION

The present invention relates to a thermal printer and more particularly to a thermal printer that is arranged so as to eliminate unevenness of hardness of covering rubber constituting a platen roller thereby preventing unevenness of an image derived from this unevenness of hardness or the like.

Image recording (also referred to as "thermal image recording") using a thermal recording material such as a thermal film or the like is utilized in recording an image produced in diagnosis by ultrasonic scanning or the like. The above-described thermal image recording eliminates the need for wet processing and offers several advantages including convenience of handling. Hence, in recent years, the practical use of the thermal image recording is not limited to small-scale applications such as diagnosis by ultrasonic scanning and an extension to those areas of medical diagnosis such as MRI (magnetic resonance imaging), X-ray photography and the like where images of large size are required is also under way.

As is known, the thermal image recording involves the use of a thermal head in which heat-generating elements for heating the thermal recording material imagewise so as to record the image are arranged in one direction; and the thermal head and the thermal recording material are relatively transported in a direction perpendicular to the direction in which the heat-generating elements extend thereby performing the image recording. In the thermal image recording, energy is applied to respective heat-generating elements of the thermal head based on image signals to heat them imagewise thereby accomplishing image recording.

As is also known, thermal image recording is basically categorized into two types, i.e., a direct recording (direct print) system for recording an image using a monochromatic or multicolor thermal color-forming material and a transfer recording system for performing monochromatic or multicolor transfer recording using an ink ribbon or the like. Various types of specific methods are put into practice in respective recording systems.

For the thermal image recording, in any of the direct thermal recording and transfer recording systems, the thermal head, particularly, a glaze of a recording section, is pressed against the thermal recording material on the platen (platen roller). In this case, it is without saying that enhancing the accuracy of a relative position between the glaze of the thermal head and the platen is necessary. As a reference of the above, for example, description of Unexamined Published Japanese Patent Application (Kokai) No. 295440/1997 can be referred to.

Besides, in the practical thermal image recording (hereinafter referred to simply as "image recording"), various characteristics of covering rubber of the platen (the platen roller), namely, material quality, physical properties, sizes and interrelations therebetween are important. In case they are not appropriate, even if the accuracy of the relative position between the glaze of the thermal head and the platen roller has been enhanced, image defects in various forms of unevenness may appear on the recorded images obtained as a result of the image recording. These forms of unevenness, blurs of images and the like were influential factors which have decreased the qualities of images recorded with the thermal printer.

As is described in detail in Unexamined Published Japanese Patent Application (Kokai) No. 76697/1998 "Uneven density compensation method of thermal recording apparatus", it is known that uneven density derived from recording density is generated in a border where recorded density changes greatly. This type of density unevenness is generated in the following steps:

For example, when the recorded image as shown in FIG. 7 is formed, friction between the thermal recording material and the thermal head varies in accordance with density to be recorded so that torque of a transport motor necessary for transporting the thermal recording material varies greatly.

Next, in accordance with changes of the torque, a shape of the platen roller varies; and the larger the change of the torque the larger the deformation of the platen roller. When the transport torque changes from a smaller side to a larger side, the platen roller is rapidly deformed whereas when the transport torque changes from a larger side to a smaller side, the deformed platen roller tends to rapidly recover its original form. Therefore, in the recorded image illustrated in FIG. 7, when an edge part where a lower density portion in a lower side of the figure is shifted into a high density portion in the middle of the figure is recorded, the transport torque is rapidly decreased, the greatly deformed platen roller goes back to the original state and a transport rate of the thermal recording material becomes fast for a moment and recording density is decreased; hence, a white streak is generated in a traverse direction in the figure.

On the other hand, in the recorded image illustrated in FIG. 7, when a border where the high density portion in the middle of the figure is shifted into a low density portion in an upper portion of the figure is recorded, the transport torque is rapidly increased, the platen roller is greatly deformed and the transport rate of the thermal recording material becomes slower for a moment and the recording density is increased; hence, a black streak is generated in the traverse direction in the figure.

Such a traverse streak derived from a large density change of the recorded image deteriorates the quality of the recorded image so that elimination of such traverse streak, as well as elimination of the image quality deterioration (decrease of clarity and generation of a blur) derived from the fluctuation of the pressing force between the thermal head and the platen roller, has been desired.

SUMMARY OF THE INVENTION

The present invention has been accomplished under the foregoing circumstances and has an object to provide a thermal printer which is capable of overcoming the above-described problems inherent in the prior art whereupon a high-quality image without unevenness of the image, unevenness derived from a streak, blur or the like can be recorded.

After an intensive study has been made to attain the above-described object, the present inventor has found that, though it is of course important that not only enhancing the accuracy of a relative position between a glaze of a thermal head and a platen roller, but also various characteristics of covering rubber of the platen roller, namely, material quality, physical properties, sizes and interrelations therebetween are important in practical thermal image recording, there exists a fixed causal relationship between generation of unevenness ordinarily called as a traverse streak due to load fluctuation and unevenness of hardness of covering rubber of the platen roller and also found that there exists a fixed causative relationship between the quality (clearness, presence or absence of blur or the like) of the recorded image and an pressing force between the thermal head and the platen roller to achieve the present invention.

In other words, the thermal printer of the present invention comprises a thermal recording head for recording an image on a thermal recording material by keeping contact therewith at a predetermined pressure and a platen roller that is arranged to face the thermal recording head and that supports and transports the thermal recording material to be recorded thereon, wherein the platen roller is covered with covering rubber in which a relation between hardness H (degree) and thickness t (mm) satisfies the following formula:

$$5t+30 \leqq H \leqq 5t+50$$

Here, in the thermal printer according to the present invention, it is preferable that the predetermined pressure in terms of a pressure to be provided between the thermal recording head and the platen roller on a unit width basis on the platen roller is 200 to 400 gf/cm.

Preferably, the thermal recording head records the image with at least 256 gradations on the thermal recording material Preferably, the thermal recording material is a material to be recorded with a direct recording system.

Preferably, the thermal recording material is a transparent material.

Preferably, the thermal recording material is a monochromatic recording material.

DETAILED DESCRIPTION OF THE INVENTION

A thermal printer in accordance with the present invention will now be described in detail with reference to the preferred embodiments shown in the accompanying drawings.

Figure 1:
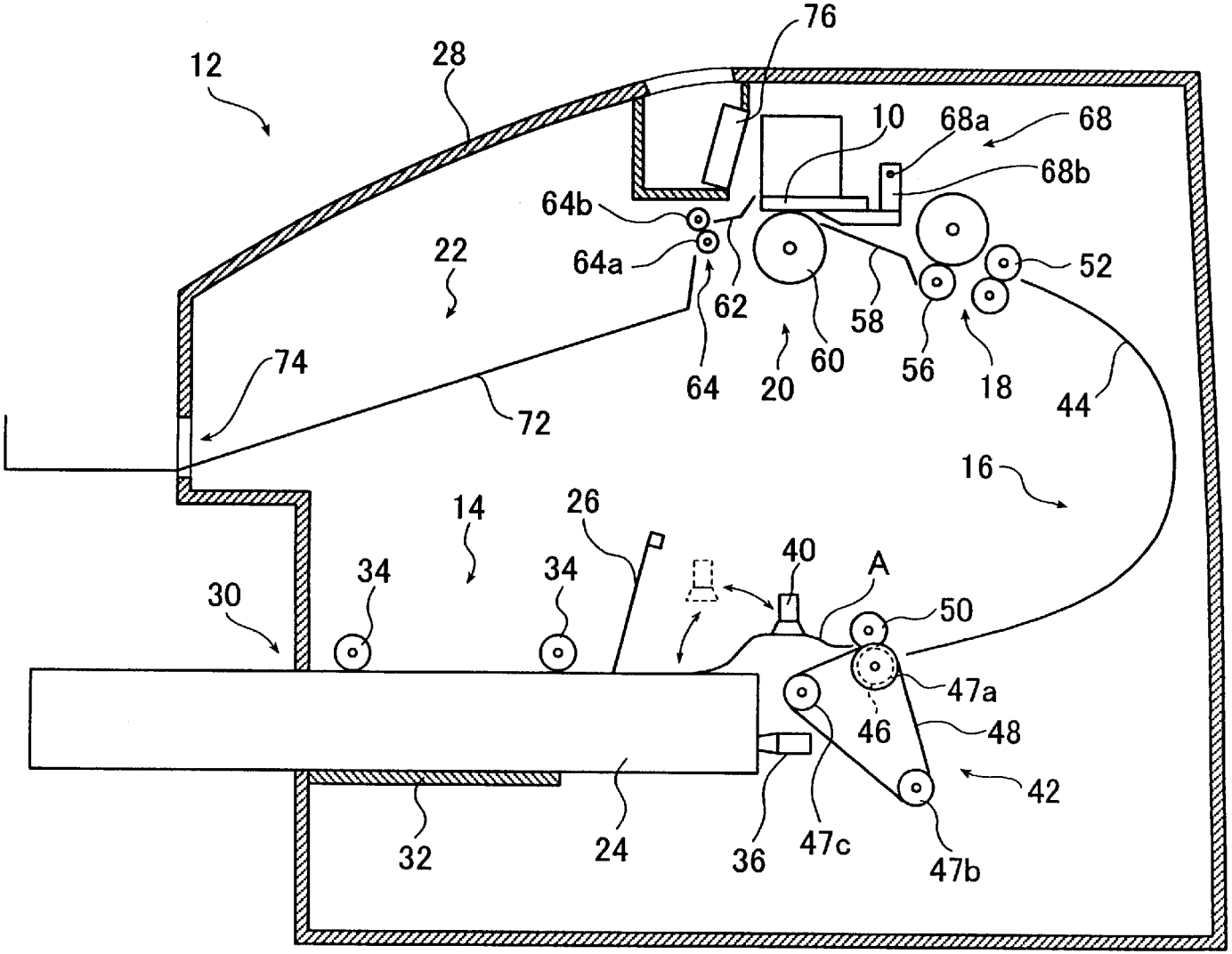
FIG. 1 is a schematic cross-sectional view in a typical form of an embodiment of a thermal printer in accordance with the present invention.

FIG. 1 is a schematic cross-sectional view in a typical form of an embodiment of a thermal printer in accordance with embodiments of the present invention. The thermal printer 12 shown in FIG. 1 for performing thermal image recording on cut sheets of thermal recording material A of a given size by means of a thermal head 10 comprises a loading section 14, a feed and transport section 16, a recording and transport section, a recording section 20 having a pressurizing and support unit 68 of the thermal head for supporting the above-described thermal head 10 and uniformly pressing against a platen roller 60 to be described later at an appropriate pressure, and an ejecting section 22.

In the thermal printer 12 in accordance with the present embodiment, various types of the thermal recording materials such as a transparent film, for example, a monochromatic film to be described later (for use in recording an image produced in diagnosis by ultrasonic scanning), a color paper (for use in recording a three dimensional image of CT: computer tomography, a reference image or in other applications) and the like are used as the thermal recording material A.

A number of sheets of the thermal recording materials such as the above-described monochromatic film, color paper or the like are stacked and accommodated in a magazine 24 with the thermal recording layer side facing down. The magazine 24 is a case having a cover 26 and is loaded in the loading section 14 of the thermal printer 12.

The loading section 14 has an inlet 30 formed in a housing 28 of the thermal printer 12, a guide plate 32, guide rollers 34 and a stop member 36. The magazine 24 is inserted into the housing 28 of the thermal printer 12 via the inlet 30 in a manner that the portion fitted with the cover 26 is coming first; thereafter, the magazine 34 is pushed, while it is guided by the guide plate 32 and the guide rollers 34, until it contacts the stop member, whereupon it is loaded at a predetermined position in the thermal printer 12.

The feed/transport section 16 has a sheet feeding mechanism using a sucker 40, a transport unit 42 and a transport guide 44; the thermal recording material such as the above-described monochromatic film, color paper or the like is taken out of the magazine 24 and then transported to the recording/transport section 18 downstream in a transport direction. The transport unit 42 comprises a transport roller 46, a pulley 47*a* coaxial with the transport roller 46, a pulley 47*b* coupled to a rotating drive source, a tension pulley 47*c*, an endless belt 48 stretched between the three pulleys 47*a*, 47*b* and 47*c*, and a nip roller 50 that is to be pressed onto the transport roller 46; the forward end of the thermal recording material which has been sheet-fed from the magazine 24 by means of the sucker 40 is pinched between the transport roller 46 and the nip roller 50 such that the thermal recording material is transported in a downstream direction.

When a signal for the start of recording on the thermal recording material is issued in the thermal printer 12 in accordance with the present embodiment, the cover 26 of the magazine 24 is opened by an open/close mechanism (not shown). Then, the sheet feeding mechanism using the sucker 40 feeds the forward end of the thermal recording material to the transport unit 42 (transport roller 46 and nip roller 50).

The thermal recording material fed to the transport unit 42 is transported to the recording/transport section 18 by means of the transport unit 42 while it is guided by the transport guide 44. At the point of time when the thermal recording material has been pinched between the transport roller 46 and the nip roller 50, the thermal recording material is released from the suction generated by the sucker 40. Also, at the point of time when the thermal recording material for use in recording has been completely ejected from the magazine 24, the above-described open/close mechanism closes the cover 26 of the magazine 24.

The recording/transport section 18 comprises a regulating roller pair 52, a transport roller pair 56 and a guide 58. First of all, the forward end of the thermal recording material transported by the transport unit 42 reaches the regulating roller pair 52. A distance between the transport unit 42 and the regulating roller pair 52 which is defined by the transport guide 44 is set to be somewhat shorter than the length of the thermal recording material in the direction of its transport. The regulating roller pair 52 are first at rest. When the forward end of the thermal recording material reaches the regulating roller pair 52, a temperature of the thermal head 10 is checked and, if it is at a predetermined level, the regulating roller pair 52 starts to transport the thermal recording material (this step will be described in more detail later), which is then transported to the recording section 20 while it is guided by the guide 58.

The recording section 20 comprises the platen roller 60, the thermal head 10, a pressurizing and support unit 68 of the thermal head 10 which supports the thermal head 10 itself and, at the same time, presses it against the platen roller 60, a guide 62, a transport roller pair 64 comprising a capstan roller 64*a* and a pressing roller 64*b*, a cooling fan 76 and the like. The thermal head 10 is supported by a head fixing arm 68*b* which can pivot about a fulcrum 68*a* of the pressurizing and support unit 68. Before the thermal recording material is transported to the recording section 20, the above-described head fixing arm 68*b* has been pivoted to a position such that the thermal head 10 is not in contact with the platen roller 60.

When the forward end of the thermal recording material has been transported to the recording START position (the position corresponding to the glaze of the thermal head 10) by the recording/transport section 18, the head fixing arm 68*b* is pivoted and accordingly the thermal recording material is pinched between the thermal head 10 and the platen roller 60, as well as the thermal head 10 presses the thermal recording material onto the platen roller 60 uniformly at a predetermined pressure by the pressurizing and support unit 68 over the entire thermal head length.

Thus, the thermal recording material is recorded with images thermally with the thermal head 10 while it is transported in the downstream direction by the platen roller 60 while it is held in registry with a predetermined position relative to the thermal head 10. The thermal image recording to be performed by the thermal head 10 will be described in more detail later.

After the end of the thermal image recording, the thermal recording material is transported by the platen roller 60 and the transport roller pair 64 while it is guided by the guide 62 to be ejected to a tray 72 in the ejecting section 22. A portion of the tray 72 projects exterior to the housing 28 of the thermal printer 12 via an outlet 74 formed in the housing 28 of the thermal printer 12 of the present embodiment; and the thermal recording material carrying the recorded image is ejected via the outlet 74 for takeout by an operator.

The thermal image recording (hereinafter referred to simply as "image recording") process will now be described in detail. Here, as an example, the image recording on the monochromatic film will be described. Such image recording is utilized, for example, in recording an image produced in diagnosis by ultrasonic scanning or the like.

Such image recording can use the thermal recording material (for example, the thermal recording material disclosed in Unexamined Published Japanese Patent Application (Kokai) No. 166640/1998) that has a thermal recording layer in which microcapsules containing a coloring agent and a developer are dispersed in a binder. The thermal recording material comprises a support member, such as a resin film, paper or the like (here, as an example, a transparent polyethylene terephthalate (PET) film is used) with the above-described thermal recording layer being formed on one surface thereof. Such thermal recording material is hereinafter referred to simply as "monochromatic film A."

The thermal recording material is not limited to the above-described thermal recording material having the thermal recording layer in which microcapsules containing the color forming agent and the developer are dispersed in the binder, but the thermal recording material, for example, disclosed in Unexamined Published Japanese Patent Application (Kokai) No. 175037/1997, that is a recording material having at least one type of thermal factor containing an organic silver salt which is substantially non-photosensitive and an organic reducer which is for the silver salt and in a thermal-reactive relation with the organic silver salt on a support member can favorably be used, wherein the outermost layer of the recording material contains at least one type of solid lubricant having a melting point of less than 150° C. and at least one type of liquid lubricant in a binder and wherein at least one type of the above-described lubricants is a derivative of phosphoric acid.

Figure 2:
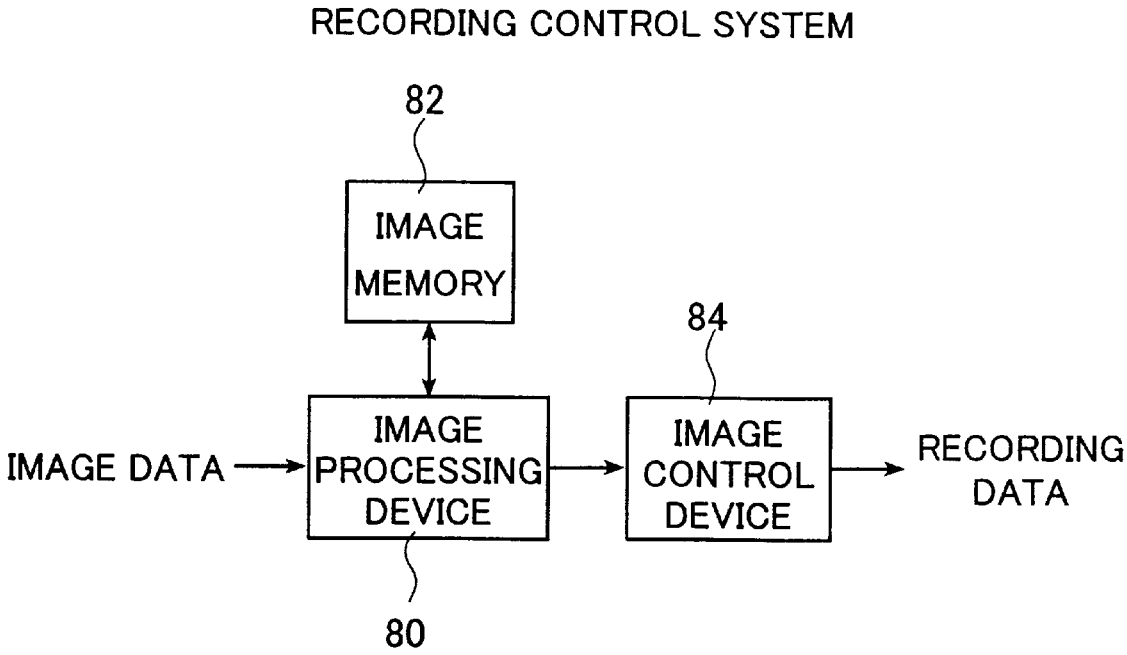
FIG. 2 is a diagram showing a schematic structure of an embodiment of a recording control system for a thermal head of the thermal printer shown in FIG. 1.

The image recording on the above-described monochromatic film A is performed by using the thermal head 10 capable of performing thermal recording at a recording (pixel) density of, say, about 300 dpi on thermal films, for example, up to B4 size. As shown in FIG. 2, the system for controlling the recording with the thermal head 10 comprises essentially an image processing device 80, an image memory 82 and a recording control device 84. The image data from an image data supply source such as the above-described CT, MRI or the like are sent to the image processing device 80 that is the combination of various types of image processing circuits and memories.

In the present invention, the image data to be supplied to the thermal head 10 is image data with high gradation, for example, image data with more than 8 bits and, preferably, can exhibit a recording gradation of more than 256 gradations while the thermal head 10 can preferably record more than 256 gradations as a recording gradation on the thermal recording material A. Because unevenness of hardness, traverse streaks due to load fluctuation, blurs of the image or the like is particularly problematic in a high gradation side, for example, in gradation recording of more than 256 gradations as a recording gradation.

After the image data have been formatted (enlargement, reduction and frame assignment) by a processing section (not shown) within the image processing device 80 if necessary, the image data are corrected in order to obtain an appropriate image and subsequently converted into image data with more than 8 bits (256 gradations as a recording gradation) for thermal recording with the thermal head 10 and finally outputted to the image memory 82. The recording control device 84 reads the image data stored in the image memory 82 line by line in the main scanning direction and outputs image signals (voltage application time corresponding to image density gradation) modulated so as to have a recording gradation of more than 256 in response to the thus read image data with 8 bits for thermal recording to the thermal head 10.

Each recording point of the thermal head 10 is heated in response to the above-described image signals to perform image recording while the monochromatic film A is transported by the platen roller 60 or the like. The monochromatic film A that has been subjected to the image recording is transported by the platen roller 60 while it is guided by the guide 62 to be ejected into the tray 72 in the ejecting section 22.

A sequence of the transport of the monochromatic film A and image recording thereon in the above-described image recording operations onto the monochromic film A is shown in FIGS. 3A–3D.

Figure 3A:
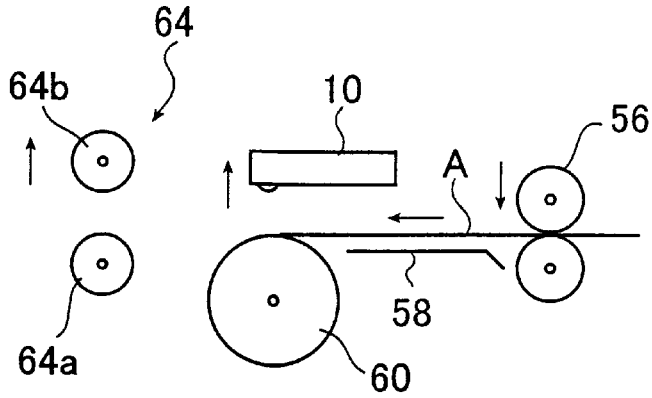
FIGS. 3A to 3D are views of a sequence of image recording operations to be performed on a monochromatic film by the thermal printer shown in FIG. 1.
Figure 3B:
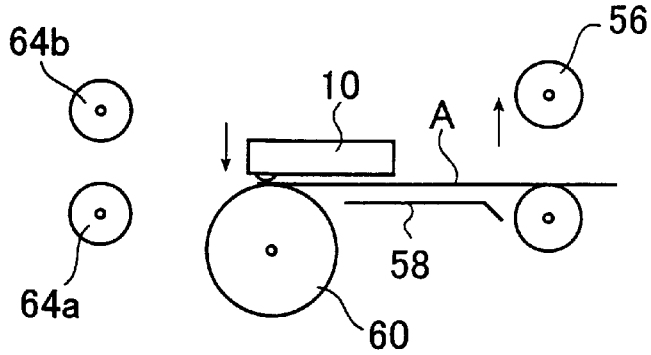

FIG. 3A shows the state in which the monochromatic film A is transported to the recording section 20 by the transport roller pair 56, the guide 58 and the like. When the monochromatic film A reaches the image recording START position, as shown in FIG. 3B, the thermal head 10 is pressed against the platen roller 60 to be ready for a recording operation. Subsequently, the recording process is started; in this case, as shown in FIG. 3C, the monochromatic film A is subjected to the image recording while it is transported by the platen roller 60.

Figure 3C:
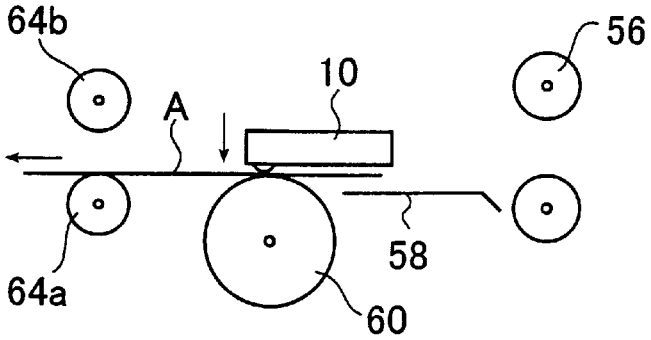
Figure 3D:
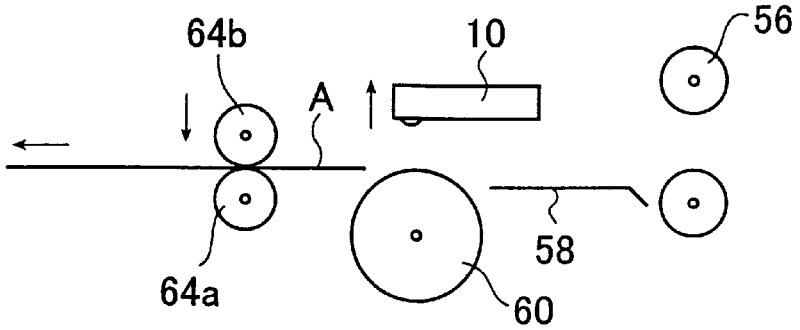

As shown in FIG. 3C, during the time when the image recording has been performed onto the monochromatic film A, a pressing roller 64*b* is retracted to a position apart from a capstan roller 64*a*. When the image recording has been performed, the pressing roller 64*b* is returned back to a position in which it contacts the capstan roller 64*a* with pressure; and, as shown in FIG. 3D, the monochromatic film A that has been subjected to the image recording is transported in a direction in which the monochromatic film A is ejected.

A structure of the platen roller 60 used in the above-described image recording will be described in detail.

Figure 4:
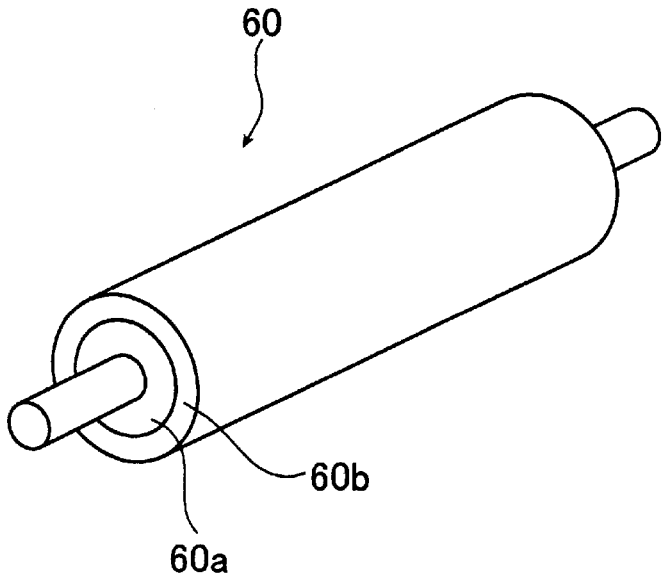
FIG. 4 is a perspective view of a structure of an embodiment of a platen roller of the thermal printer shown in FIG. 1.

FIG. 4 is a perspective view of a structure of a platen roller 60. The platen roller 60 comprises a metallic core 60*a* with covering rubber 60*b* having a heat resistance such as silicone rubber wound therearound.

Metal constituting the metallic core 60*a* may be any metal as long as it has high coefficient of elasticity. For example, stainless steel (SUS), iron, aluminum (Al), brass or the like can be taken as a typical example. The covering rubber 60*b* is not limited to any particular type but any type of rubber is permissible as long as it is heat resistant rubber satisfying the desired hardness described below. For example, silicone rubber, fluororubber, EPT (ethylene-prolylene terpolymer), CR (chloroprene rubber), or the like can be exemplified.

As described above, the composition (material quality, physical properties such as hardness or the like, sizes such as thickness or the like) of the covering rubber 60*b* of the platen roller 60 affects the quality of the image such as unevenness called as a traverse streak due to load fluctuation, a blur of recorded image or the like.

In the present invention, it is necessary for the covering rubber 60*b* of the platen roller 60 to satisfy the following formula when hardness measured with a JIS-A hardness meter is represented by H (degree) and thickness is represented by t $$5t+30 \leqq H \leqq 5t+50$$

Moreover, pressure to be provided between the thermal head 10 and the platen roller 60 is preferably 200 to 400 gf/cm on a basis of a unit width of platen roller 60 (unit length along the direction of a rotation axis of the platen roller 60).

For example, in the above-described image recording, the platen roller 60 with the following characteristics can be employed:

the thickness t of the covering rubber 60*b* is 4 mm;

the hardness H (with the JIS-A hardness meter) of the covering rubber is 60 degrees; and pressing force between the thermal head 10 and the platen roller 60 is 300 gf/cm on the basis of the unit width of the platen roller 60.

The following explanation is directed to the reason for definition of requirements for the covering rubber 60*b* of this platen roller 60:

First of all, in the thermal printer 12 shown in FIG. 1, each solid image with a density of 0.3 to 0.5 has been subjected to thermal recording on a monochromatic film A (thermal recording material comprising PET as a support body as disclosed in Unexamined Published Japanese Patent Application No. 166640/1998) of a half-size (356 mm×432 mm) under the following conditions:

pressing force between the thermal head 10 and the platen roller 60 was set as 300 gf/cm;

thickness of the covering rubber 60*b* of the platen roller 60 was set as 1 mm, 2 mm, 4 mm and 6 mm by being varied in a range of 1 mm to 6 mm; and hardness H was set every 10 degrees between 30 and 90 degrees to be defined in 4 to 5 references for each thickness described above.

Here, as the covering rubber 60*b* of the platen roller 60, silicone rubber type G96A from Showa Electric Wire & Cable Co., Ltd. was employed.

The hardness was measured under the following conditions:

thickness t of the sample is 12 mm;

load is 1000 gf; and hardness meter is a JIS-A type.

Figure 5:
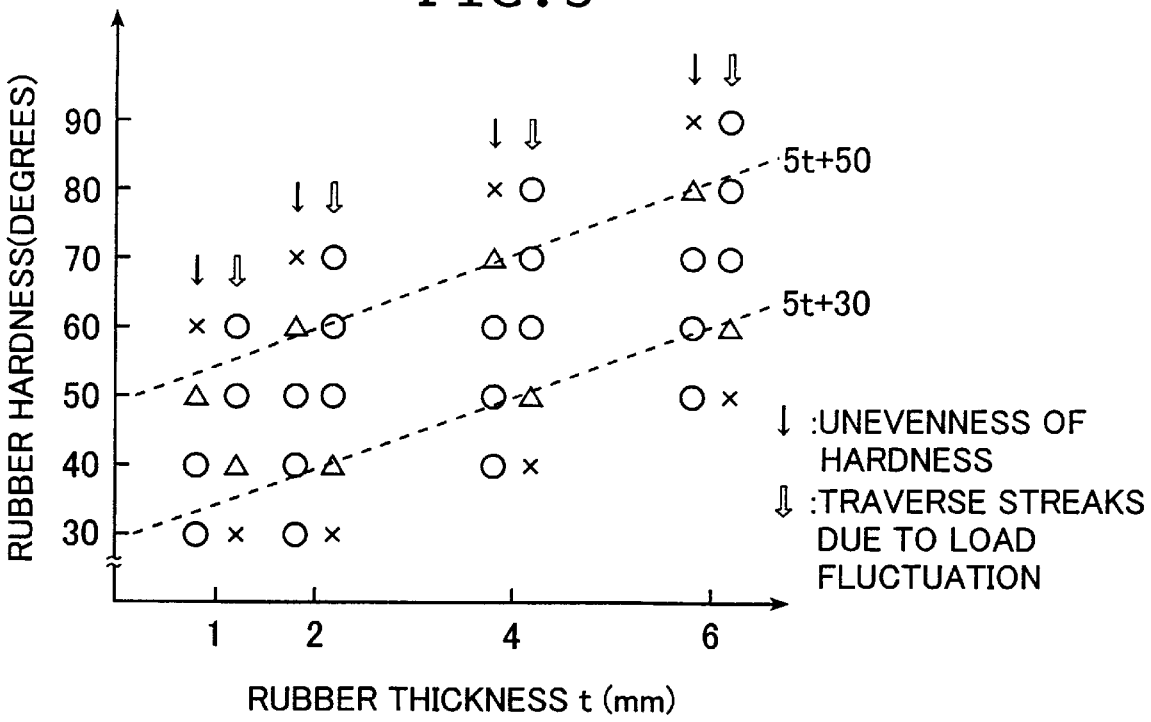
FIG. 5 is a graph showing examples of levels of generation of unevenness of hardness of covering rubber of the platen roller and levels of generation of traverse streaks due to load fluctuation when thickness t and hardness H of the covering rubber of the platen roller are changed in the thermal printer shown in FIG. 1.

The thus obtained thermal recording image is viewed with human eyes (visually evaluated), a level of generation of unevenness of hardness of the covering rubber 60*b* of the platen roller 60 is evaluated from the above visual evaluation of the level of generation of image unevenness and then a level of generation of a traverse streak due to load fluctuation which is considered to be derived from the unevenness of hardness is visually evaluated. The result is shown in Table 1 and a graph representing the result in Table 1 is shown in FIG. 5.

In Table 1 and FIG. 5, an evaluation criterion of unevenness of hardness and traverse streaks due to load fluctuation in thermal recording images is as follows:

○; there was no image unevenness due to the unevenness of hardness or traverse streak due to load fluctuation so that this is no problem.

Δ; there was slightly observed the image unevenness due to the unevenness of hardness and the traverse streaks due to load fluctuation so that this is a little problematic but is permissible practically.

×; there was observed the image unevenness due to the unevenness of hardness and the traverse streaks due to load fluctuation so that diagnosis based on the image may be inappropriate and problematic.

TABLE 1

| Rubber Thickness (mm) | 1 | | | | 2 | | | | | 4 | | | | | 6 | | | | |
|---|---|---|---|---|---|---|---|---|---|---|---|---|---|---|---|---|---|---|---|
| Hardness (degrees) | 30 | 40 | 50 | 60 | 30 | 40 | 50 | 60 | 70 | 40 | 50 | 60 | 70 | 80 | 50 | 60 | 70 | 80 | 90 |
| Uneveness of Hardness | ○ | ○ | Δ | X | ○ | ○ | ○ | Δ | X | ○ | ○ | ○ | Δ | X | ○ | ○ | ○ | Δ | X |
| Traverse Streaks Due to Load Fluctuation | X | Δ | ○ | ○ | X | Δ | ○ | ○ | ○ | X | Δ | ○ | ○ | ○ | X | Δ | ○ | ○ | ○ |

As shown in FIG. 5, it is understood that there is no problem or at least no practical problem as long as the thickness t (mm) and the hardness H (degree)of the covering rubber 60*b* of the platen roller 60 are present in an area defined by two dotted lines; H=5t+50 and H=5t+30 because levels of generation of the unevenness of hardness and the traverse streaks due to load fluctuation are low. Therefore, it is understood that, in the present invention, the relationship between the thickness t (mm) and the hardness H (degree) of the covering rubber 60*b* of the platen roller 60 may preferably be defined as follows:

$$5t+30 \leqq H \leqq 5t+50$$

As shown in Table 1 and FIG. 5, there exist the optimal values between thickness t (mm) and hardness (degree) of the covering rubber 60*b* of the platen roller 60 in a manner that the levels of generation of the unevenness of hardness and the traverse streaks due to load fluctuation become favorable. For example, when the thickness t (mm) is 2, the hardness H (degree) is 50; when t is 4, H is 60; when t is 6, H is 70 and so forth. Therefore, the optimal values can be expressed by the formula: H=5t+40.

Next, in the thermal printer 12 shown in FIG. 1, each solid image with a density of 0.3 to 0.5 has been recorded in a similar manner as above on a monochromatic film A (thermal recording material comprising PET as a support body as disclosed in Unexamined Published Japanese Patent Application No. 166640/1998) of a half-size (356 mm×432 mm) using the same covering rubber 60*b* of the platen roller 60 under the following conditions to check blurs of the image and then evaluated by human eyes:

thickness of the covering rubber was set as 4 mm;

hardness H was set as 60 degrees; and pressing force between the thermal head 10 and the platen roller 60 (or platen pressure in Table 2) was set every 50 gf/cm between 150 gf/cm and 450 gf/cm.

Figure 6:
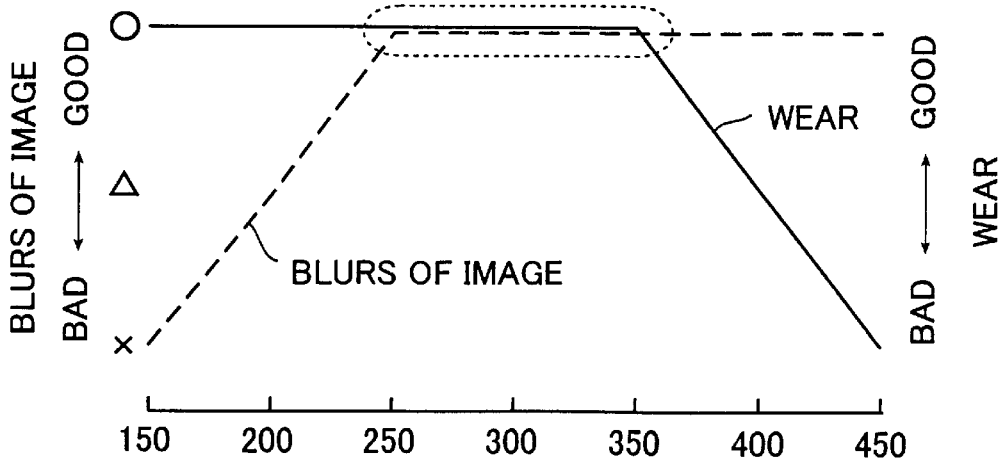
FIG. 6 is a graph showing examples of levels of blurs of an image and levels of wear of a thermal head when a pressing force between the thermal head and a platen roller is changed in the thermal printer shown in FIG. 1.
Figure 7:
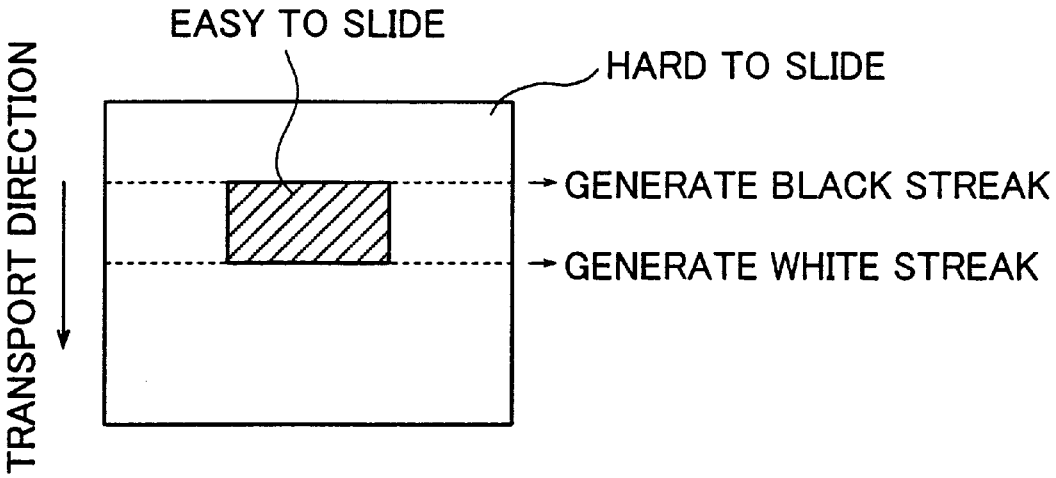
FIG. 7 PRIOR ART
FIG. 7 is a view explaining a reason for generating traverse streaks due to load fluctuation in a conventional thermal printer.

Moreover, in order to check wearability of the thermal head, each solid image with a density of about 3.0 has been recorded on the monochromatic film A for loom long and then the worn amount of the thermal head has been measured. The result is shown in Table 2 and a graph representing the result in Table 2 is shown in FIG. 6.

In Table 2 and FIG. 6, an evaluation criterion of the blurs of the image in the thermal recorded images and the wear of the thermal head is as follows:

○; there was no blur of the image or wear (0.1 μm/100 m or less) of the thermal head so that this is no problem.

Δ; there were slightly observed the blurs of the image and the wear (0.1 to 0.2 μm/100 m) of the thermal head so that this is a little problematic but is permissible practically.

×; there were observed the blurs of the image and the wear (0.2 μm/100 m or more) of the thermal head so that this is problematic.

TABLE 2

| Platen Pressure (gf/cm) | 150 | 200 | 250 | 300 | 350 | 400 | 450 |
|---|---|---|---|---|---|---|---|
| Blurs of Images | X | Δ | ○ | ○ | ○ | ○ | ○ |
| Wear | ○ | ○ | ○ | ○ | ○ | Δ | X |

As shown in Table 2 and FIG. 6, it is understood that, as long as the pressing force between the thermal head 10 and the platen roller 60 is in a range of 200 to 400 gf/cm, levels of the blurs of the image and the wear of the thermal head is both small so that they are no problem or at least no practical problem. Therefore, it is understood that, in the present invention, the pressing force between the thermal head 10 and the platen roller 60 may preferably be defined as being between 200 and 400 gf/cm.

Moreover, as shown in Table 2 and FIG. 6, there exist the optimal values also for the pressing force between the thermal head 10 and the platen roller 60 in a manner that the levels of the blurs of the image and the levels of the wear of the thermal head become favorable. The optimal value of the pressing force can be read from Table 2 and FIG. 6 as being 250 to 350 gf/cm.

According to the above embodiment, by investigating characteristics of the covering rubber 60*b* of the platen roller 60, the unevenness of the hardness of the covering rubber 60*b* of the platen roller 60 is prevented and accordingly the generation of the image unevenness called as the traverse streaks due to the load fluctuation possibly caused by the above-described unevenness of hardness can be suppressed and, moreover, by investigating the pressing force between the thermal head 10 and the platen roller 60, the thermal printer capable of obtaining recorded images of high-quality having no unevenness, blurs or the like can be provided.

As the thermal recording material to be used in the present invention, the transparent film, namely, a transparent material is preferable and the monochromatic film comprising the transparent PET described above as the support body is most preferable. Because in the transparent film, particularly monochromatic film, the unevenness of the hardness (causing the image unevenness), the traverse streaks due to the load fluctuation, the blurs of the image or the like deteriorates the image even if they are slightly present.

In the above embodiment, as an exemplary illustration, the monochromatic thermal recording material A has been used. The present invention is not limited to the above material A, but a monochromatic paper, a color film, a color paper and various other thermal recording materials can also be used.

As has been described in the above, according to the present invention, by investigating and defining characteristics, sizes or the like of the covering rubber constituting the platen roller, the thermal printer capable of obtaining a recorded image of high-quality without generating the unevenness of the image, the unevenness derived from the streaks, blurs or the like can be achieved.

In other words, in the thermal printer of the present inventor, generation of the unevenness of the image, the unevenness derived from the streaks, the blurs or the like can be prevented by setting the relation between the thickness t and hardness H of the covering rubber constituting the platen roller and moreover preferably the pressing force between the thermal head and the platen roller in a predetermined relation, particularly, in an optimal relation.

What is claimed is:

1. A thermal printer comprising:

a thermal recording head for recording an image on a thermal recording material by keeping contact therewith at a predetermined pressure; and a platen roller that is arranged to face the thermal recording head and that supports and transports said thermal recording material to be recorded thereon, wherein said platen roller is covered with covering rubber in which a relation between hardness H (degree) and thickness t (mm) satisfies the following formula:

$$5t+30 \leqq H \leqq 5t+50.$$

2. The thermal printer according to claim 1, wherein said predetermined pressure in terms of a pressure to be provided between said thermal recording head and said platen roller on a unit width basis of the platen roller is 200 to 400 gf/cm.

3. The thermal printer according to claim 1, wherein said thermal recording head records said image with at least 256 gradations on said thermal recording material.

4. The thermal printer according to claim 1, wherein said thermal recording material is a material to be recorded with a direct recording system.

5. The thermal printer according to claim 4, wherein said thermal recording material is a transparent material.

6. The thermal printer according to claim 5, wherein said thermal recording material is a monochromatic recording material.

* * * * *